United States Patent [19]

Schulte

[11] Patent Number: 4,714,042

[45] Date of Patent: Dec. 22, 1987

[54] BARGE COUPLER ASSEMBLY

[76] Inventor: Frank Schulte, Box 26, Mayo, Fla. 32066

[21] Appl. No.: 923,042

[22] Filed: Oct. 24, 1986

[51] Int. Cl.[4] ..... B63B 3/08

[52] U.S. Cl. ..... 114/77 R; 114/249; 114/266; 114/352

[58] Field of Search ..... 114/77 R, 266, 249, 114/352; 14/27; 403/6, 408.1

[56] References Cited

U.S. PATENT DOCUMENTS

| | | | |
|---|---|---|---|
| 2,328,693 | 9/1943 | Taylor | 114/77 R |
| 2,584,685 | 2/1952 | Evert | 114/352 |
| 4,610,215 | 9/1986 | Robishaw | 114/266 X |

*Primary Examiner*—Sherman D. Basinger

*Attorney, Agent, or Firm*—Dowell & Dowell

[57] ABSTRACT

Coupler assemblies for permitting the selective connection of two or more barges or other water borne floating vessels or structures wherein one or more pairs of vertically spaced coupler boxes are united in fluid tight communication with one another along one or more side walls of such vessels or structures in such a manner as to be open through the side walls, decks and bottom walls thereof and wherein upper and lower opposing coupler boxes of adjacent vessels or structures are united by upper and lower longitudinally extending connector pins which are retained in assembled relationship within opposing coupler boxes by first and second vertically oriented wedge pins which are accessible from the decks of the respective vessels or structures.

18 Claims, 8 Drawing Figures

Fig. 1
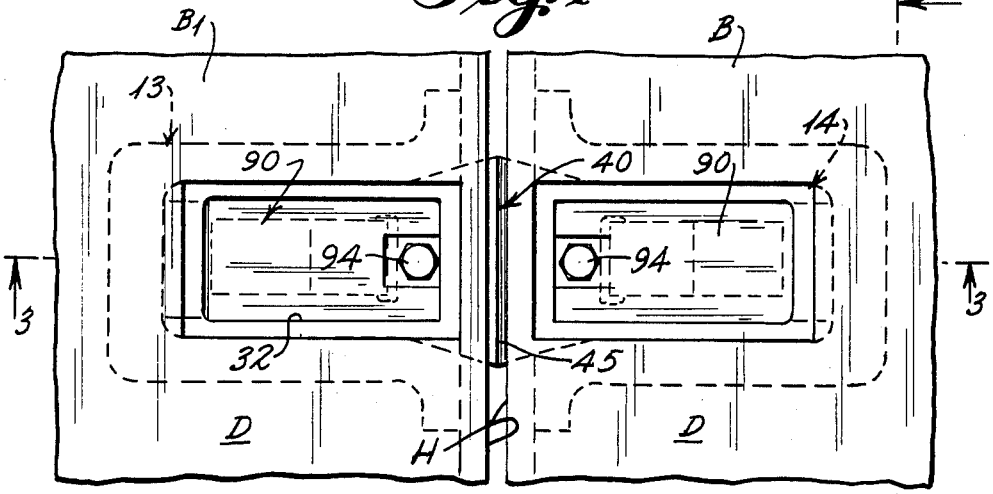
Fig. 4
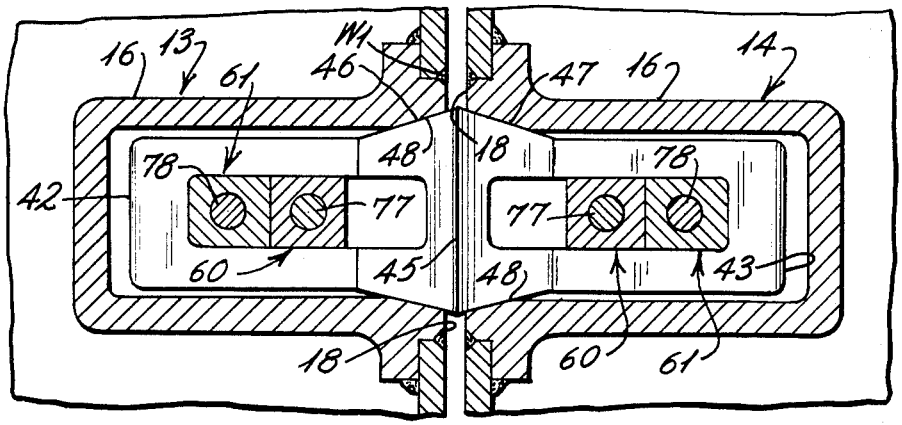
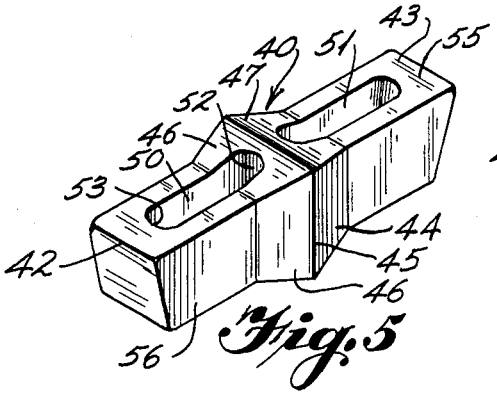
Fig. 5
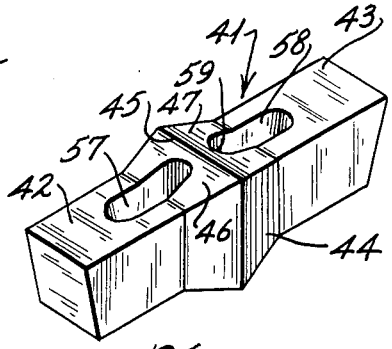
Fig. 6

Fig. 2
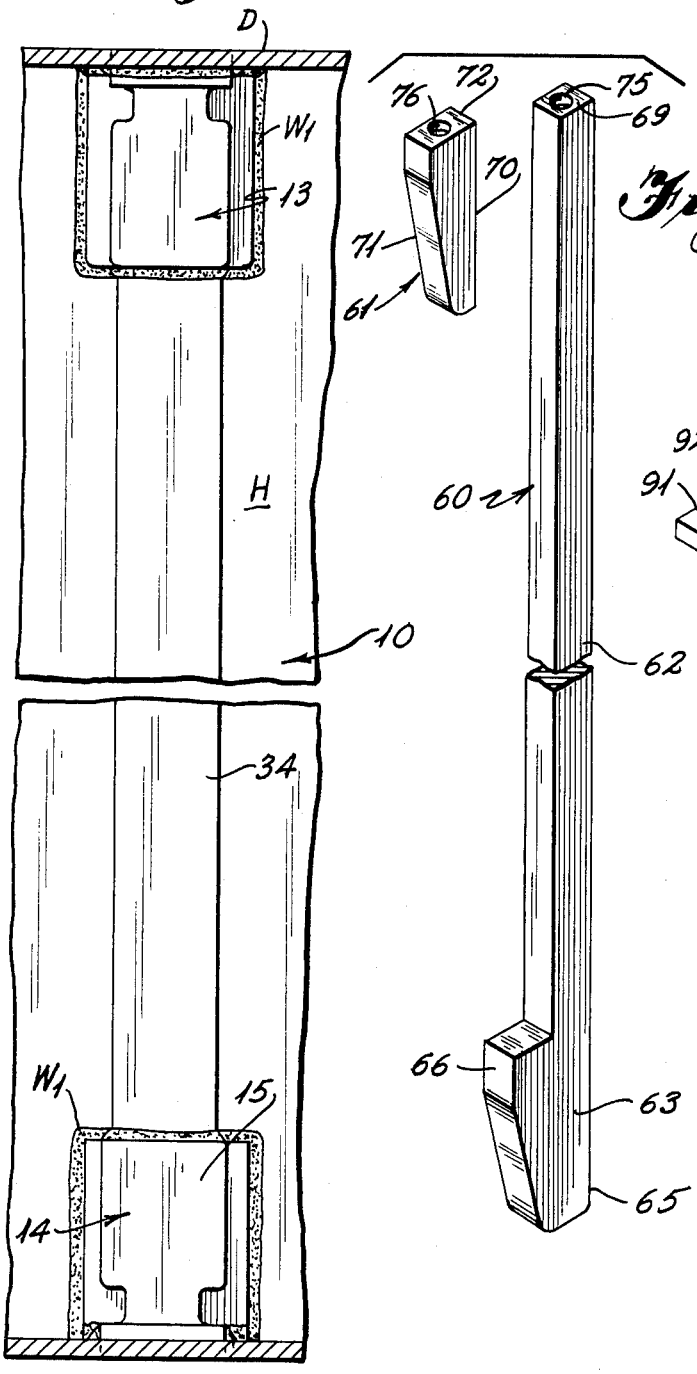
Fig. 7
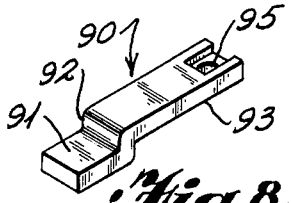
Fig. 8

BARGE COUPLER ASSEMBLY

BACKGROUND OF THE INVENTION

1. Field of the Invention

This invention is generally directed to connectors or couplings for joining two or more floating structures into assembled relationship with respect to one another and particularly to connectors or couplings for selectively joining two or more marine vessels or structures such as barges, pontoons, dredges and the like in securely locked and positively positioned relationship with one another so that the joined structures can be effectively operated and controlled as a single vessel or unit and wherein the couplings are easily and quickly connected utilizing connector pins and wedges which are selectively mounted within vertically spaced coupler housings or boxes which are installed within each of the vessels.

2. History of the Prior Art

Heretofore, there have been a number of structures designed and developed to facilitate the joining of two or more vessels to form a single multi-hull unit which can be operated and controlled as a single body. The connection of floating water borne vessels is particularly advantageous when dealing with barges which may be joined with one another so as to be simltaneously moved from point to point by a single power source. In addition to the foregoing, various construction barges, dredges, floating pontoons and the like are also frequently assembled in joined relationship in order to form a unified working body or structural element.

In U.S. Pat. No. 2,328,693 to Taylor, a design for a marine vessel is disclosed which includes a pair of connectable hull sections which are retained in assembled relationship by a coupling assembly. The coupling assembly includes an elongated coupling member which extends into sockets provided in each hull section of the vessel and which is retained in place by elongated wedge bars which extend through the deck, coupling member and bottom of the hull sections. Such a coupling structure requires that the vessel sections be abutted against one another and thereby creates a situation wherein such hull sections may be damaged or adversely worn as such sections are shifted with respect to one another due to normal wave action or other stresses imparted to the vessel.

In addition to the foregoing, the connecting assembly of Taylor utilizes a single generally centrally located connector pin member which necessarily must be extremely large and therefore very bulky and difficult to install. Therefore, the sectionalized structure is one which is not easily connected or disconnected by crew members. Further, the connecting assembly is retained in position by wedge bars which extend upwardly from the bottom of the hulls and through the decks. The wedge bars not only create an obstruction on the deck of the vessel but are also formed in such a manner that installation thereof must be from the bottom of the hull thereby making it very impractical to assemble and disassemble adjacent hull sections into associated relationship with respect to one another.

A more current float connection assembly is disclosed in U.S. Pat. No. 3,805,721 to Robishaw. In the Robishaw structure, a first floating section is provided with a pair of outwardly extending locking pin members which are selectively aligned with sockets or connector housings mounted within an adjacent floating section. The connection between the sections is accomplished by an elongated locking assembly which is insertable vertically downwardly through the connector housings or sockets in one of the floating sections with each locking assembly being retained in a locked position with respect to the connector pins by a spring bar which extends substantially along the vertical length of the locking assembly. This structure requires that various floating sections or vessels be modified to include the connector pins with other floating sections or vessels modified to include sockets. In this manner, it is not possible to selectively connect adjacent floating sections from any side as each section must be approached so that the connector pin members are cooperatively received within the sockets of an adjacent floating section. In addition, the connection between the locking assembly and the connector pins is accomplished by utilizing an elongated locking assembly which must be guided vertically into engagement with the lower connector pin by an elongated track or connection assembly. As the component parts of the track or connector assembly will be exposed to water, over a period of time, the sliding engagement of the coupling parts will cause such parts to bind with one another thereby making the connection of the assembly more difficult. Also, the spring members which are utilized to urge the locking assembly into engagement with the locking pins may become weaker because of repeated usage thereby making the locking assembly less effective.

Some other examples of the prior art include U.S. Pat. Nos. 3,057,315 to Robishaw, 4,060,048 to Breheret et al. and 4,066,030 to Milone.

SUMMARY OF THE INVENTION

This invention is directed to coupler assemblies for selectively connecting or joining two or more water borne vessels, crafts, floats or similar structures including barges, dredges, pontoons, floating platforms and the like wherein such structures are simultaneously connected at spaced vertical locations so that the resultant assembly responds as a relatively unified body. Each coupler assembly includes a pair of vertically spaced interchangeable coupler housings or boxes which are mounted through spaced openings provided in a side wall or hull portion and aligned openings in the deck and bottom of each vessel. Each housing includes a first horizontal opening through the vessel side wall and a pair of second openings oriented vertically on the top and bottom thereof. The vertically spaced housings are joined in open communication with one another by an elongated tubular coupler element which is joined in fluid tight relationship with each coupler housing so that no fluid will pass through the coupler assembly and into the interior of the vessel hull or other structure. Upper and lower connection pins are selectively positioned so as to be cooperatively seated in horizontal orientation within each pair of upper and lower opposing coupler housings of adjacent vessels or structures. Each connection pin includes a pair of spaced vertically oriented passageways or openings therein which are tapered inwardly from top to bottom and are aligned with the tubular coupler element which extends between the vertically spaced coupler housings. The openings in the upper connection pins are larger than those of the lower pins. The central portion of each connection pin is enlarged so as to effectively seal the horizontally oriented openings in each coupler housing while simultaneously insuring that the hulls of adjacent vessels are maintained in spaced relationship with one another. The upper and lower coupler pins are selectively locked into position within the vertically spaced housings by first elongated wedge pins which extend downwardly through the openings in the upper coupler housings and which include a tapered end portion which is frictionally locked within the openings of the lower connection pin. Thereafter, shortened wedge pins are driven within the openings of the upper connector pins to thereby bind the upper portion of the elongated wedge pins within the upper connector pins.

It is the primary purpose of the present invention to provide coupler assemblies for selectively joining two or more floating barges or other water borne vessels or structures into proximate relationship with one another so that the joined sections may be operatively controlled as a single unit and wherein the couplings may be effected expeditiously with a minimum of manual labor and effort.

It is another object of the present invention to provide coupler assemblies for joining a plurality of barges or similar water borne vessels so that such vessels may be operated as a single unit wherein the coupler assemblies may be easily and quickly engaged or disengaged from the decks of the vessels being joined or separated.

It is yet another object of the present invention to provide coupler assemblies for selectively connecting two or more floating structures and especially barges and the like into secure engagement with one another wherein each coupler assembly includes vertically spaced housings which are selectively united with the vertically spaced housings of the coupler assembly of an adjacent vessel by horizontally oriented connector pins which are positioned therein and which are frictionally locked in place by a pair of wedge members in such a manner that stresses normally imparted to the connection members are equally distributed between the coupler assemblies of both vessels so that potentially destructive loads or forces are transmitted and distributed throughout the coupler assemblies and the adjacent areas of the vessels as if the vessels were integrally united with one another.

It is also an object of the present invention to provide coupler assemblies for joining two or more floating barges or other vessels wherein the housings are installed so as to be substantially flush with the exterior surfaces of adjacent vessels so that as the vessels are brought into proximate relationship to one another, no projections are present which could cause damage to the adjacent vessel.

It is a further object of the present invention to provide coupler assemblies for joining two or more floating vessels wherein each vessel is provided with connector housings which selectively receive connector pins which extend between the vessels so that the pins may be initially installed on any vessel thereby making it possible for such vessel to be joined in a random manner with other vessels.

It is another object of the present invention to provide coupler assemblies for joining two or more floating vessels wherein the coupler housings installed in the vessels are identical with one another so that the housings may be installed in any vertical orientation within the vessels.

It is yet another object of the present invention that the coupler assemblies permit the vessels to be selectively joined regardless of the vertical orientation of the top and bottom of the vessels.

BRIEF DESCRIPTION OF THE DRAWINGS

FIG. 1 is a partial top plan view of a pair of adjacent barges or similar vessels showing the coupler assembly of the present invention as it is installed with such vessels.

FIG. 2 is a cross sectional view taken along lines 2—2 of FIG. 1 showing the tubular element which extends within each vessel and connects a pair of upper and lower coupler housings in open and yet fluid tight communication with the interior of the hull of the vessel.

FIG. 4 is a cross sectional view taken with respect to the upper coupler housings of the vessel of FIG. 1 taken along lines 4—4 of FIG. 3.

FIG. 5 is a perspective view of the upper connector pin shown in FIG. 4.

FIG. 6 is a perspective view of the lower connector pin of the present invention and which are shown in cross section in FIG. 3.

FIG. 7 is a perspective view of the first and second locking wedge pins of the present invention.

FIG. 8 is a perspective view of an optional locking plate which may be used to restrict access to the installed locking wedge pins.

DESCRIPTION OF THE PREFERRED EMBODIMENT

Figure 3:
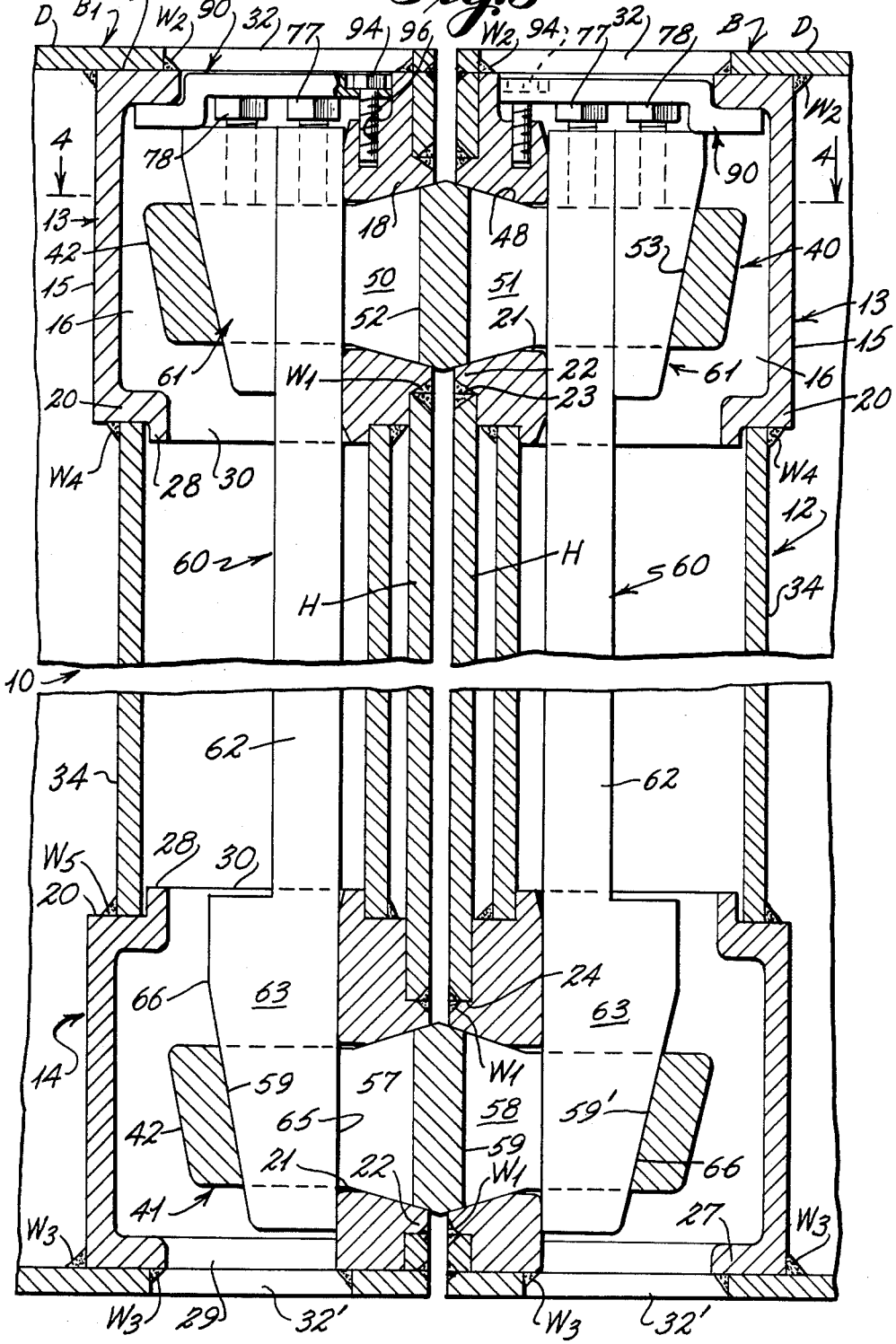
FIG. 3 is a cross sectional view taken along lines 3—3 of FIG. 1.

With continued reference to the drawings, a coupler assembly 10 is shown as being installed through the hull H of adjacent barges generally designated at B1 and B2. The coupler assembly is designed primarily for use in selectively joining water borne vessels such as river barges and is designed to be installed along any portion of the hull of such vessels so that such vessels may be joined in end to end or side by side relationship with respect to one another. Another feature of the present invention is that once the housing portions of the coupler assemblies are installed with respect to a particular vessel, as will be described in greater detail hereinafter, the connection between adjacent vessels may be accomplished directly from the decks D1 and D2 of the respective vessels B1 and B2 or the vessels may be rotated or floated in an upside-down orientation so that the bottoms of the vessels serve as the decks and still remain selectively unitable with one another.

The coupler assemblies of the present invention include enclosed housing subassemblies 12 which are designed to be permanently installed with respect to a marine vessel. As will be discussed with respect to the preferred embodiment, the enclosed housing subassemblies will be described as they are mounted within the hull of a vessel, however, it should be noted that such subassemblies could also be installed to the exterior of the hull although the spacing between adjacent barges would then be somewhat greater and thus the interior installation is not only preferred but will also reduce the likelihood of damage between vessels.

With particular reference to FIG. 3 of the drawings, the enclosed housing subassemblies of the present invention will be described in greater detail. Each of the enclosed housing subassemblies 12 includes an upper and lower coupler housing or box 13 and 14, respectively. Each of the upper and lower coupler boxes or housings are identically constructed so as to be interchangeable and include a rear wall 15, side walls 16 and 17, front wall 18 and top and bottom walls 19 and 20. As shown in FIG. 3, the front wall of the housings may be formed or cast to be somewhat broader than the remaining wall portions for purposes to be described in greater detail hereinafter. A generally rectilinear opening 21 is provided in the front wall 18 of each of the upper and lower coupler housings or boxes. Each opening 21 is defined by outwardly extending flange portions 22 which form a rectilinear frame that extends from the front wall of the housings. The outer edges of each of the flanges 20 are shown as being cooperatively received in abutting relationship within openings 23 and 24 which are made through the side wall of the hull H of the vessels B1 and B2. It is preferred that the upper openings 23 in the hulls H be made in spaced relationship just below the deck of the vessel so that the top wall 19 of the upper coupler housing or box 13 will be positioned generally flush with or just below the deck when installed. The lower openings 23 through the hulls H are preferably located at the lower portion of the hull so that the lower coupler housing or box 14 will be positioned so that the wall 19 thereof will be generally flush with the bottom B of the hull. Each of the outwardly extending flange portions 20 are sealed within the openings 23 and 24 so as to be in fluid tight communication with the hull by lines of welding as shown at W1. The upper coupler housings or boxes 13 are welded to the undersurface of the deck by lines of welding W2 and the lower coupler housings or boxes are welded to the bottom of the hull by lines of welding W3.

The upper and lower coupler housings or boxes 13 and 14 include first and second flanged portions 27 and 28 defining aligned openings 29 and 30 therein. In order to provide access to the upper and lower coupler housings, aligned openings 32 and 32' are provided through the deck and bottom of the vessel.

The lower coupler housing or box 14 is welded, as previously disclosed, in the area of the first flanged portion 27 to the bottom of the hull so that the openings 29 and 30 therein are aligned with the openings 29 and 30 through the upper coupler housing and are also aligned with the openings 32 and 32' in the deck and bottom of the vessel. As the upper and lower coupler housings are open to water through the exterior of the hull, it is necessary that each of the housings be mounted in fluid tight relationship with one another so that no water can seep into a hull in which they are installed. In order to seal the upper and lower coupler housings within the hulls, a tubular member 34 is connected therebetween with the upper portion 35 of the tubular member being welded at W4 to the bottom wall 20 of the upper coupler housing 13 and with the lower portion 37 of the tubular member being welded at W5 to the wall 20 of the lower coupler housing 14. The flanged portions 28 of the upper and lower coupler housings will serve to align the tubular member 34 into correct position to thereby facilitate the creation of fluid tight welds between the housings and the tubular connector member.

The enclosed housing subassemblies 12 of the present invention may be installed to currently existing marine vessels such as river barges, floats, dredges and the like with a predetermined or selected number of such housing being positioned along one or more side walls of the hulls of the vessels. In this manner, one vessel may be connected to another along adjacent side walls by way of one or more coupler assemblies. The number of assemblies installed along each portion of a hull will depend upon the size of the vessel and the load normally carried thereby.

The present invention provides a unique and generally continuous coupling between adjacent vessels which coupling extends through both the upper and lower coupler housings or boxes in such a manner that stresses imparted to the coupler assemblies during use will be distributed uniformly throughout the area of the hulls adjacent the openings 23 and 24 therein. The physical assembly between the vessels is made by way of upper and lower connector pins 40 and 41 which are mounted and extend between opposing upper and lower coupler housings 13 and 14, respectively. Each of the connector pins 40 and 41 is generally similarly constructed and provide structure for not only uniting adjacent vessels but also for sealing the openings 23 and 24 through the side walls of the vessels. In addition, the connector pins simultaneously provide structure for insuring that adjacent vessels are spaced relative to one another even when coupled together.

The connector pins 40 and 41 are shown in perspective in FIGS. 5 and 6. Each connector pin includes a pair of oppositely oriented end portions 42 and 43 which extend outwardly from an enlarged central body portion 44. Each of the end portions 42 and 43 is shown as being generally rectilinear or square in cross section and is of a size to be cooperatively received through the openings 21 in the upper and lower coupler housings or boxes 13 and 14 as shown in the drawings. The central body portion 44 of each of the connector pins is enlarged and defines a generally centrally located flange element 45 which is integrally formed with each of the end portions through oppositely tapering side walls 46 and 47 which extend outwardly and downwardly from the flange 45 to the end portions of each connector pin. In order for the connector pins to be cooperatively received in each of the openings 21 of the coupler housings 13 and 14, each of the flanged portions 22 include an inwardly tapered surface 48 which is complementary in slope or angle to the slope or taper of the side walls 46 and 47 of the connector pins. In this manner, when the connector pins are positioned between opposing coupler housings, they will be securely wedged within the opposing housings as shown in FIG. 3. Also, as the central portions 44 of the connector pins are larger than the openings 21 into the coupler housings, the hulls of the opposing vessels will be retained in closely spaced relationship with respect to one another.

The upper connecting pins 40 include a pair of slotted openings 50 and 51 which extend through each of the end portions 42 and 43, respectively. The slotted openings are defined by innermost generally vertically oriented walls 52 and outermost tapering walls 53. The outermost tapering walls 53 are shown as being sloped inwardly from the top or upper surfaces 55 of the connector pins to the lower surfaces 56 thereof.

Likewise, the lower connector pins 41 include a pair of tapered openings 57 and 58 disposed through each of the end portions 42 and 43 thereof. The tapered wall openings 57 and 58 are likewise defined by innermost generally vertical side walls 59 and outer inwardly tapering walls 59'. The tapered openings 57 and 58 of the lower connector pins, however, are smaller in dimension than the openings 50 and 51 through the upper connector pins.

After the connector pins have been inserted between opposing upper and lower coupler housings or boxes, such pins are retained in fixed position by pairs of locking or wedge pins or elements 60 and 61. The wedge element 60 is shown as having an elongated rod-like portion 62 which is generally rectilinear in cross section although other configurations may be used. An enlarged head 63 is integrally formed at one end of the rod 62. The head portion 63 of wedge element 60 is of a size to pass through the openings in the upper connector pins and is defined having a rear side wall 65 which is coextensive with the rear wall of the rod 62 and a front wall 66 which extends outwardly of the front wall of the rod. The front wall 66 is tapered along its length and forms a wedging surface for interfitting the head portion 63 into a frictionally locked engagement within the openings 57 and 58 of the lower connector pins 41. The rear wall 65 of the head portions of wedge members 60 is shown as abutting the front walls of the coupler housings 13 and 14 so that such cooperative engagement will distribute the stresses between the wedge members, lower connector pin, coupler housings and adjacent areas of the vessel hull. When the wedge member 60 is installed, the upper end 69, thereof, is shown as extending to a point just below the upper opening into the upper coupler housing.

Wedge element or deck wedge 61 is shown as being significantly smaller than wedge element 60 and includes an innermost generally planar wall 70 and an outermost tapering end wall 71. The wedge element 61 is of a length to extend through the openings 50 and 51 in the upper connector pin 40 with the upper surface 72 thereof being spaced generally inwardly in spaced relationship with respect to the top wall of the upper coupler housing. In this manner, the upper surface of the wedge pin or element 61 and the upper end of elongated wedge 60 will be spaced below the surface of the deck. The total cross sectional size of the wedge element 61 and the rod portion 62 of wedge element 60 will be such as to be complementary to the cross section of the openings 50 and 51 through the upper connector pins so that as wedge element 61 is driven vertically downwardly with respect thereto, wedge element 61 and the rod portion of wedge element 60 will be frictionally engaged within the openings thereby locking both the wedge pins or elements in place.

To facilitate the placement of the wedge pins or elements 60 and 61, threaded openings 75 and 76 are provided in the uppermost or end portions thereof. Impact elements such as bolts 77 and 78 having enlarged heads are threadingly received within the openings 75 and 76 and serve as surfaces which can be driven by the use of a tool such as a slide hammer, sledge or the like. When the wedge pins or elements 60 and 61 have been driven into frictionally locked engagement within the openings in the upper and lower connector pins, the ends thereof will be positioned below the deck and within the upper portion of the upper coupler housings. Thereafter, the driving pins or bolts may be selectively removed from the openings in the upper ends thereof or such elements may be covered and secured in place by a Z-shaped locking plate 90 which is shown in FIG. 8. The locking plate includes a shortened end 91 which is connected through an intermediate section 92 to an elongated end 93 which is generally parallel to end 91. The shortened ends are fitted under one flange of the upper coupler housings and thereafter, the elongated portions thereof are forced down into overlying engagement with the wedge elements. A separate fastener member 94 may be selectively threaded through an opening 95 in the Z-shaped member and into an underlying portion of the front wall of the housing which has been previously threadingly tapped as indicated at 96. As the front wall of the connector housings is somewhat greater in width than the remaining wall portions thereof, the strength of the coupler housing will not be adversely effected by the threaded opening being situated therein.

As the coupler assembly of the present invention will be utilized to join rather large marine vessels with one another, the various component parts of the assembly are formed of a heavy duty steel which is preferably treated so as to resist rust and corrosion.

In the use of the coupler assemblies of the present invention, the housing subassemblies 12 are installed within vessels such as river barges, floats, pontoons, dredges and the like.

The vessels are initially modified by cutting the openings 23 and 24 through the side of the hulls and the openings 32 on the decks. In some vessels which are floatable with the bottom serving as the deck, openings 32' are also made through the bottom of the vessels, as shown in FIG. 3. As the coupler housings 13 and 14 are structurally the same, the coupler assemblies will function in the same manner regardless of whether or not the vessel is floated normally or upside-down.

The upper and lower coupler housings or boxes 13 and 14 are mounted through the hull of the vessels in spaced and vertical alignment with one another. The tubular connecting members are thereafter positioned in place and the entire assemblies are welded so that the upper and lower coupler housings are in fluid tight communication with one another and with the walls defining the side walls, decks and bottoms of the vessels.

The upper and lower connector pins 40 and 41 are subsequently placed within the upper and lower coupler housings of one vessel. With the upper and lower connector pins in place, an elongated connecting wedge pin or element 60 is inserted down through the aligned openings 29 and 30 in the upper and lower connector pins and into the opening in the lower connector pin 41 and thereafter driven into wedged frictional engagement therewith. Thereafter, the smaller or deck wedge pin 61 is driven into the remaining open portion of the opening through the upper connector pin 40 and into wedged engagement with the connector pin and the upper rod portion of the elongated locking wedge member 60. A second vessel is then brought alongside of the first vessel with the housing subassemblies therein generally aligned with the housing subassemblies in the first vessel. As the vessels are brought into close proximity with one another, the outwardly projecting end portions of the connector pins will enter into the housings of the second vessel. The enlarged central portion of the connector pins will insure that the pins are wedged within the openings 21 into the coupler housings and also prevent the hulls of the vessels from contacting one another. Another elongated wedge member 60 is then driven down through the openings in the connector pins which extend into the second vessel thereby wedging the head portion of the elongated rod within the opening of the lower connector pin. A second smaller wedge member 61 is subsequently driven into frictioned engagement with the upper rod portion of the elongated wedge member 60 and within the opening in the upper connector pin to thereby frictionally secure the entire coupling assembly into locked engagement.

As the wedge members and connector pins are frictionally and integrally locked with one another and as the enlarged portion of each connector pin is frictionally engaged within the openings into each of the upper and lower housings, any stress which is created by the relative movement of one vessel with respect to another will be distributed throughout the system of coupler elements. Any forces or stress will likewise be distributed uniformly throughout the wall or hull portion of the vessel adjacent to the couplings.

In the event it is desired to release or disconnect one vessel from another, it is only necessary to remove the wedge pins from one of the sets of upper and lower housings thereby freeing one end of the upper and lower connector pins.

Due to the generally flush or smooth mounting of the coupler housings with respect to the walls of a vessel, the housings can be installed without creating any potentially dangerous projections or protrusions and are therefore safe even when the coupler assemblies are not in use.

I claim:

1. A coupling apparatus for selectively connecting two or more floating marine structures wherein each structure includes a hull portion and a deck portion comprising upper and lower aligned and vertically spaced coupler housings which are mounted to the hull portions of each structure, each of said upper and lower coupler housings having a first opening therein which is generally horizontally oriented outwardly with respect to the hull of the floating marine structure and a second opening which is vertically oriented upwardly generally perpendicularly with respect to said first opening, at least said upper coupler housing having a third downwardly oriented opening therein which is generally axially aligned with said second opening of said lower coupler housing, a first connector means removably disposed within said first openings of said upper coupler housings and a second connector means removably disposed within said first openings of said lower coupler housings, each of said first and second connector means having an intermediate portion and opposite end portions, said end portions being of a size to pass through said first openings and into said upper and lower coupler housings, said first openings being defined by side walls of predetermined configuration, said intermediate portion of said first and second connector means being of a size to be cooperatively seated with said side walls defining said first openings into said upper and lower coupler housings and including an outermost flange portion which extends outwardly beyond said first openings in said upper and lower coupler housings so that said flange portion will retain said upper and lower coupler housings in spaced relationship with respect to one another, and retainer means extendable through said upper coupler housings and into said lower coupler housings and engageable with said first and second connector means to retain said first and second connector means within said upper and lower coupler housings, respectively.

2. The coupling apparatus of claim 1 including enclosure means extending between said third opening in said upper coupler housing and said second opening in said lower coupler housing, said first and second coupler housings being sealed in fluid tight communication with one another through said enclosure means.

3. The coupling apparatus of claim 2 in which said first and second connector means include a downwardly and inwardly tapered opening through each end thereof on either side of said intermediate portion.

4. The coupling apparatus of claim 3 in which said first and second connector means are generally rectilinear in cross section and said intermediate portion of said first and second connector means includes a central outwardly extending portion which is integrally connected with said end portions thereof by inwardly tapering wall portions.

5. The coupling apparatus of claim 3 in which said retainer means includes a first wedge member having an elongated rod portion with a head at the lower end thereof, said head portion including a tapered wall surface, said elongated rod member being extendable vertically through said upper and lower coupler housings and said enclosure means, and said head portion of said elongated rod member being frictionally received within said tapered openings in said end portions of said second connector means so as to simultaneously engage said second connector means and said lower coupler housing.

6. The coupling apparatus of claim 5 in which said retainer means includes a second wedge member, said second wedge member being frictionally received within said tapered openings in said first connector means to retain said rod portion of said elongated rod member within said tapered openings.

7. The coupling apparatus of claim 6 in which said tapered openings in said second connector means are relatively smaller than the tapered openings in said first connector means.

8. The coupling apparatus of claim 7 including locking means selectively mounted over said first and second wedge members, said locking means being selectively secured to said upper coupler housing so as to prevent the withdrawal of said first and second wedge members therefrom.

9. The coupling apparatus of claim 8 in which an opening is provided in the deck portion of the floating marine structure and said second opening in said upper coupler housing being aligned in proximate relationship with the opening in the deck.

10. The coupling apparatus of claim 9 which said upper and lower coupler housings are similarly constructed so as to be interchangeable with one another.

11. A coupling apparatus for selectively joining a pair of floating marine structures wherein each structure includes a hull portion and a deck having an opening therein comprising upper and lower vertically spaced coupler housings mounted through the hulls of the marine structures, each of said upper and lower coupler housings having a first opening therein which is generally horizontally oriented outwardly with respect to the hulls and a second opening which is vertically oriented upwardly generally perpendicularly with respect to said first opening and is aligned with the opening in the decks, at least said upper coupler housing having a downwardly oriented opening therein which is aligned with said second opening in said lower coupler housing, enclosure means extending between said downwardly oriented openings in said upper coupler housings and said second openings in said lower coupler housings so that said upper and lower coupler housings are in fluid tight communication with one another therethrough, first connector means removably disposed within said first openings of said upper coupler housings and second connector means removably disposed within said first openings of said lower coupler housings, each of said first and second connector means having an intermediate portion and opposite end portions, said end portions being of a size to pass through said first openings and into said upper and lower coupler housings, said first openings being defined by side walls of a predetermined configuration, said intermediate portions of said connector means being of a size to be cooperatively seated with said side walls defining said first openings into said upper and lower coupler housings, a vertically oriented tapered opening through each of said end portions of said first and second connector means, elongated wedge members having an elongated body portion and an enlarged head portion, said head portions of said elongated wedge members being cooperatively received within said tapered openings in said end portions of said second connector means and said body portion of said elongated wedge members extending through said tapered openings in said end portions of said first connector means, and a second wedge member cooperatively received within said tapered openings in said end portions of said first connector means to thereby retain said body portion of said elongated wedge members therein.

12. The coupling apparatus of claim 11 in which said intermediate portion of said first and second connector means includes an outermost flange portion which extends outwardly beyond said first openings in said first and second coupler housings so that said flange portion will retain said first and second housing in spaced relationship with respect to one another.

13. The coupling apparatus of claim 12 in which said tapered openings in said second connector means are relatively smaller than the tapered openings in said first connector means.

14. The coupling apparatus of claim 12 including locking means selectively mounted with said upper coupler housing over said first and second wedge members, said locking means being selectively secured to said upper coupler housing so as to prevent the withdrawal of said first and second wedge members therefrom.

15. The coupler apparatus of claim 12 in which said head portion of said first wedge member is frictionally received between said end portions of said connector means and said lower coupler housing.

16. A coupling apparatus for selectively joining a pair of floating marine structures wherein each structure includes a hull portion and a deck having an opening therein comprising upper and lower vertically spaced coupler housings mounted through the hulls of the marine structures, each of said upper and lower coupler housings having a first opening therein which is generally horizontally oriented outwardly with respect to the hulls and second and third openings which are vertically aligned generally perpendicularly with respect to said first opening so as to be aligned with the opening in the decks, enclosure means extending between said third openings in said upper coupler housings and said second openings in said lower coupler housings so that said upper and lower coupler housings are in fluid tight communication with one another therethrough, first connector means removably disposed within said first openings of said upper coupler housings and second connector means removably disposed within said first openings of said lower coupler housings, each of said first and second connector means having an intermediate portion and opposite end portions, said end portions being of a size to pass through said first openings and into said upper and lower coupler housings, said first openings being defined by side walls of a predetermined configuration, said intermediate portions of said connector means being of a size to be cooperatively seated with said side walls defining said first openings into said upper and lower coupler housings, a vertically oriented tapered opening through each of said end portions of said first and second connector means, elongated wedge members having an elongated body portion and enlarged head portion, said head portions of said elongated wedge members being cooperatively received within said tapered openings in said end portions of said second connector means and said body portion of said elongated wedge members extending through said tapered openings in said end portions of said first connector means, and a second wedge member cooperatively received within said tapered openings in said end portions of said first connector means to thereby retain said body portion of said elongated wedge members therein.

17. The coupling apparatus of claim 16 in which said intermediate portion of said first and second connector means includes an outermost flange portion which extends outwardly beyond said first openings in said first and second coupler housings so that said flange portion will retain said first and second housings in spaced relationship with respect to one another.

18. The coupling apparatus of claim 17 in which said tapered openings in said second connector member are relatively smaller than the tapered openings in said first connector member and said head portion of said first wedge member is frictionally received between said end portions of said connector means and said lower coupler housing.

* * * * *